US010325544B2

(12) United States Patent
Liu et al.

(10) Patent No.: US 10,325,544 B2
(45) Date of Patent: Jun. 18, 2019

(54) DATA INPUT UNIT, DATA INPUT METHOD, SOURCE DRIVE CIRCUIT AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Chenxi Liu, Beijing (CN); Weibiao Geng, Beijing (CN); Yu Xie, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 109 days.

(21) Appl. No.: 15/537,692

(22) PCT Filed: Sep. 14, 2016

(86) PCT No.: PCT/CN2016/098952
§ 371 (c)(1),
(2) Date: Jun. 19, 2017

(87) PCT Pub. No.: WO2017/128735
PCT Pub. Date: Aug. 3, 2017

(65) Prior Publication Data

US 2018/0053458 A1 Feb. 22, 2018

(30) Foreign Application Priority Data

Jan. 27, 2016 (CN) ..... 2016 1 0055243

(51) Int. Cl.
*G09G 3/20* (2006.01)

(52) U.S. Cl.
CPC ..... *G09G 3/2018* (2013.01); *G09G 3/20* (2013.01); *G09G 3/2096* (2013.01);
(Continued)

(58) Field of Classification Search
USPC ..... 345/691
See application file for complete search history.

(56) References Cited

U.S. PATENT DOCUMENTS 6,181,317 B1 * 1/2001 Taguchi ..... G09G 3/3677 345/698
2004/0012581 A1 1/2004 Kurokawa et al.
(Continued)

FOREIGN PATENT DOCUMENTS

CN 101231836 A 7/2008
CN 101673528 A 3/2010
(Continued)

OTHER PUBLICATIONS

ISR and Written Opinion dated Dec. 14, 2016; PCT/CN2013/098952.
The First Chinese Office Action dated Dec. 14, 2017, Appln. No. 201610055243.4.

*Primary Examiner* — Chineyere D Wills-Burns
(74) *Attorney, Agent, or Firm* — Ladas & Parry LLP

(57) ABSTRACT

A data input unit, a data input method, a source drive circuit and a display device. The data input unit includes: an input module, configured to provide a normal display data; a setting module, configured to preset one or more predetermined display data; and a selection module, configured to select the input module to provide the normal display data to a data input end or select the setting module to provide a special predetermined display data to the data input end, according to the one or more external control signals. Thus, besides a normal driving function, other special driving
(Continued)

functions also may be provided for special display demands so as to improve the performance and display quality of a display device.

9 Claims, 5 Drawing Sheets

(52) U.S. Cl.
CPC ..... *G09G 2300/0814* (2013.01); *G09G 2310/027* (2013.01); *G09G 2310/0275* (2013.01); *G09G 2310/0286* (2013.01); *G09G 2330/027* (2013.01); *G09G 2370/08* (2013.01)

(56) References Cited

U.S. PATENT DOCUMENTS

2007/0001939 A1* 1/2007 Hashimoto ..... G09G 3/3233 345/76
2008/0158126 A1* 7/2008 Tung ..... G09G 3/3648 345/92
2008/0238952 A1* 10/2008 Kanou ..... G09G 3/3607 345/690
2011/0292011 A1* 12/2011 Lee ..... G09G 3/3611 345/208
2012/0139343 A1* 6/2012 Adest ..... H02J 3/385 307/43
2015/0154943 A1* 6/2015 Lee ..... G09G 5/18 345/204
2015/0212381 A1* 7/2015 Wu ..... G09G 3/3655 349/41
2016/0275859 A1 9/2016 Tseng
2017/0124985 A1* 5/2017 Kim ..... G09G 3/34
2017/0154592 A1 6/2017 Ji et al.

FOREIGN PATENT DOCUMENTS

CN 103943064 A 7/2014
CN 104867469 A 8/2015
CN 105654887 A 6/2016
JP 2012-133182 A 7/2012

* cited by examiner

DATA INPUT UNIT, DATA INPUT METHOD, SOURCE DRIVE CIRCUIT AND DISPLAY DEVICE

TECHNICAL FIELD

Embodiments of the present disclosure relate to a data input unit, a data input method, a source drive circuit and a display device.

BACKGROUND

A source driver integrated circuit in a display apparatus scans in a predetermined order after decoding a digital signal in a predetermined format, so as to send an analog signal to each data line. In general, a data input unit of a source drive circuit only comprises an input module (for instance, an input register) so as to provide a normal display data to a data input end of the source drive circuit. Upon a special display demand, for instance, in the case that a display panel needs to display a black image during shutting down, or in the case that a grayscale image needs to be inserted in a blank interval between two frames of display data to improve display quality, a preset display data can not be provided to the source drive circuit, so the display quality of the display apparatus can not be improved.

SUMMARY

The present disclosure is intended for solving problems that a special driving function except a normal driving function can not be performed except a normal driving function to improve the performance and display quality of a display apparatus.

Therefore, the present disclosure provides a data input unit comprising an input module, the data input unit further comprises a setting module and a selection module, the setting module is configured to preset one or more predetermined display data; and the selection module is configured to select the input module or the setting module to provide the display data to a data input end according to the one or more external control signals.

According to an embodiment, the external control signal may comprise a shutdown control signal. In addition, the selection module may comprise a bidirectional switch. According to an embodiment, the setting module presets a first predetermined display data, and grayscale value of the first display data may be 0.

According to an embodiment, the bidirectional switch comprises a control end, a first input end, a second input end and an output end. The control end of the bidirectional switch receives the shutdown control signal, the first input end of the bidirectional switch is connected with the setting module, the second input end of the bidirectional switch is connected with the input module, and the output end of the bidirectional switch is connected with the data input end. According to an embodiment, in the case that the shutdown control signal is effective, the setting module is controlled to provide the first predetermined display data to the data input end, and in the case that the shutdown control signal is ineffective, the input module provides a normal display data to the data input end.

According to an embodiment, the external control signal may comprise a blank interval control signal. In addition, the selection module comprises the bidirectional switch. The setting module presets a second predetermined display data, and grayscale value of second display data is in a predetermined range.

According to an embodiment, the bidirectional switch comprises a control end, a first input end, a second input end and an output end. The control end of the bidirectional switch receives the blank interval control signal, the first input end of the bidirectional switch is connected with the setting module, the second input end of the bidirectional switch is connected with the input module, and the output end of the bidirectional switch is connected with the data input end. In the case that the blank interval control signal is effective, the setting module provides the second predetermined display data to the data input end, and in the case that the blank interval control signal is ineffective, the input module provides a normal display data to the data input end. In the case that the data input end receives the second predetermined display data, a grayscale image may be displayed on a display panel connected with the data input end.

According to an embodiment, the data input unit further comprises a switch control signal generation module. The external control signal may comprise the shutdown control signal and the blank interval control signal. The selection module may comprise the bidirectional switch.

The switch control signal generation module generates a switch control signal according to the shutdown control signal and the blank interval control signal; in the case that the shutdown control signal is effective or the blank interval control signal is effective, the switch control signal is controlled to be in a first state, and in the case that the shutdown control signal and the blank interval control signal both are ineffective, the switch control signal is controlled to be in a second state.

The setting module presets the first predetermined display data and the second predetermined display data. In addition, a control end of the setting module may also receive an input control signal.

According to an embodiment, the bidirectional switch comprises a control end, a first input end, a second input end and an output end. The control end of the bidirectional switch receives the switch control signal, the first input end of the bidirectional switch is connected with the setting module, the second input end of the bidirectional switch is connected with the input module, and the output end of the bidirectional switch is connected with the data input end. In the case that the switch control signal is in the first state and the shutdown control signal is effective, the setting module provides the first predetermined display data to the data input end, in the case that the switch control signal is in the first state and the blank interval control signal is effective, the setting module provides the second predetermined display data to the data input end, and in the case that the switch control signal is in the second state, the input module provides the normal display data to the data input end.

The grayscale value of the first display data may be 0. In addition, in the case that the data input end receives the second display data, the grayscale image may be displayed on the display panel connected with the data input end.

According to an embodiment, the switch control signal generation module may comprise an OR gate. The OR gate may comprise a first OR gate input end, a second OR gate input end and an OR gate output end, wherein the first OR gate input end receives the blank interval control signal, the second OR gate input end receives a reverse signal of the shutdown control signal, and the OR gate output end is connected with the control end of the bidirectional switch.

The present disclosure further provides a data input method, comprising: presetting one or more predetermined display data by a setting module; according to one or more external control signal, a selection module selecting an input module or the setting module to provide a display data to a data input end.

According to an embodiment, the external control signal may comprise a shutdown control signal. In addition, the selection module may comprise a bidirectional switch.

According to an embodiment, the setting module presets a first predetermined display data, and grayscale value of the first display data may be 0. In the case that the shutdown control signal is effective, the selection module controls the setting module to provide the first predetermined display data to the data input end, and in the case that the shutdown control signal is ineffective, the selection module controls an input module to provide a normal display data to the data input end.

According to an embodiment, the external control signal may comprise a blank interval control signal. The setting module presets a second predetermined display data, and grayscale value of the second display data is in a predetermined range. According to an embodiment, in the case that the blank interval control signal is effective, the selection module controls the setting module to provide the second predetermined display data to the data input end, and in the case that the blank interval control signal is ineffective, the selection module controls the input module to provide the normal display data to the data input end. And in the case that the data input end receives the second predetermined display data, a grayscale image may be displayed on a display panel connected with the data input end.

According to an embodiment, the data input unit further comprises a switch control signal generation module. The external control signal may comprise the shutdown control signal and the blank interval control signal. And the selection module may comprise the bidirectional switch. The switch control signal generation module is configured to generate a switch control signal according to the shutdown control signal and the blank interval control signal, wherein in the case that the shutdown control signal is effective or the blank interval control signal is effective, the switch control signal is controlled to be in a first state, and in the case that the shutdown control signal and the blank interval control signal both are ineffective, the switch control signal is controlled to be in a second state.

According to an embodiment, the setting module presets the first predetermined display data and the second predetermined display data. In addition, a control end of the setting module may also receive an input control signal.

According to an embodiment, an control end of the bidirectional switch receives the switch control signal, a first input end of the bidirectional switch is connected with the setting module, a second input end of the bidirectional switch is connected with the input module, and an output end of the bidirectional switch is connected with the data input end. In the case that the switch control signal is in the first state and the shutdown control signal is effective, the setting module provides the first predetermined display data to the data input end, in the case that the switch control signal is in the first state and the blank interval control signal is effective, the setting module provides the second predetermined display data to the data input end, and in the case that the switch control signal is in the second state, the input module provides the normal display data to the data input end. The grayscale value of the first display data may be 0. In the case that the data input end receives the second display data, a grayscale image may be displayed on the display panel connected with the data input end.

The present disclosure further provides a source drive circuit, comprising a data input end and the above mentioned data input unit.

The present disclosure further provides a display device, comprising the above mentioned source drive circuit.

The data input unit, the data input method, the source drive circuit and the display device of the present disclosure incorporate the setting module and the selection module. The setting module presets a display data corresponding to a specific display demand, the selection module selects whether the setting module needs to provide the display data to the data input end according to the external control signal. Therefore, in addition to a normal driving function, a special driving function may also be provided so as to improve the performance and the display quality of the display device.

DETAILED DESCRIPTION

The technical solutions of the embodiments will be described in a clearly and fully understandable way in connection with the drawings related to the embodiments of the disclosure. Apparently, the described embodiments are just a part but not all of the embodiments of the disclosure. It should be noted that "module" may be interpreted as "circuit" in the disclosure.

Figure 1:
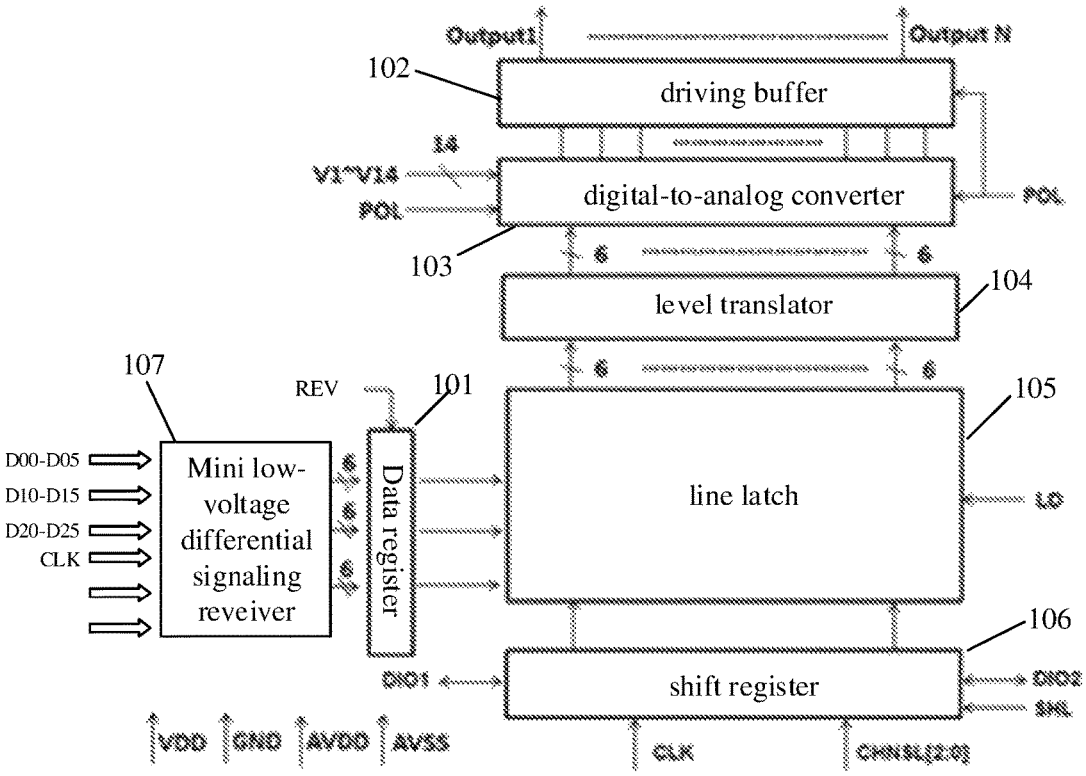
FIG. 1 is a structural view of a source drive circuit.

As illustrated in FIG. 1, a source drive circuit usually comprises an input module, a data register 101, a driving buffer 102, a digital-to-analog converter 103, a level translator 104, a line latch 105 and a shift register 106; the input module may adopt a Mini low-voltage differential signaling receiver 107.

The Mini low-voltage differential signaling receiver 107 receives display data, D00-D05, D10-D15, D20-D25, and a clock signal CLK. The data register 101 receives a data reverse control signal REV. The line latch 105 receives a load control signal LD. The shift register 106 receives the clock signal CLK, an output channel number selection setting terminal signal CHNSL[2:0], a scanning direction control signal SHL, a first order control signal DIO1 and a second order control signal DIO2; the scanning direction control signal SHL is configured to control the IC to scan from left to right or from right to left. The digital-to-analog converter 103 receives a polarity reversal signal POL and the reference voltages V1-V14 for gamma circuits. The driving buffer 102 comprises N channels (N is a positive integer), and outputs the first output signal Output1 to the Nth output signal OutputN.

In the FIG. 1, VDD represents a supply voltage for a logic circuit module, AVDD represents a supply voltage for an analog circuit module, GND represents a reference ground level of the logic circuit module, and AVSS represents a reference ground level for the analog circuit module.

As illustrated in FIG. 1, in the usual source drive circuit, a data input unit only comprises the input module (for instance, the Mini low-voltage differential signaling receiver 107), and therefore, in the case that there is a special display demand, it is not possible to provide a predetermined display data to the source drive circuit.

Figure 2:
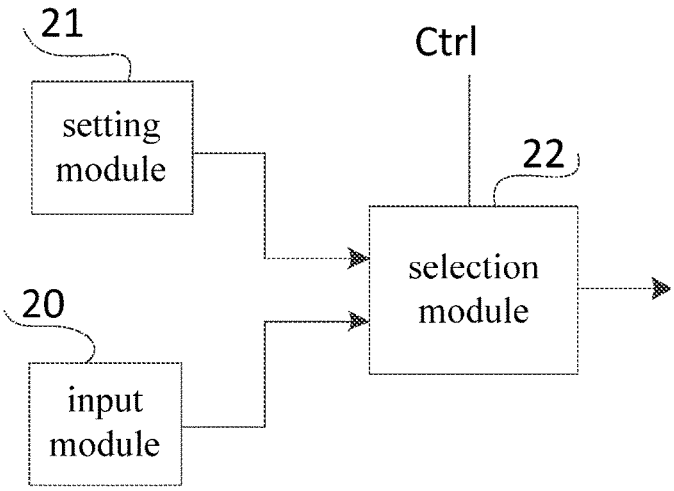
FIG. 2 is a structural frame chart of a data input unit of an embodiment of the present disclosure.

As illustrated in FIG. 2, a data input unit of embodiments of the present disclosure comprises an input module 20 configured to provide a normal display data. In addition, the data input unit of an embodiment of the present disclosure further comprises a setting module 21 and a selection module 22; the setting module 21 is configured to preset one or more predetermined display data; the selection module 22 is configured to select the input module 20 or the setting module 21 to provide the display data to a data input end according to an external control signal Ctrl.

The data input unit of an embodiment of the present disclosure incorporates the setting module 21 and the selection module 22, the setting module 21 presets one or more predetermined display data corresponding to a special display demand, the selection module 22 selects whether the setting module 21 needs to provide the predetermined display data to the data input end according to the external control signal Ctrl so as to satisfy the special display demand, for instance, a black image is displayed on a display panel during the display device being shut down, or a grayscale image is inserted in a blank interval between two frames of display data to improve display quality.

According to an embodiment, the input module 20 may be an input register, for instance, the input module 20 may be a Mini low-voltage differential signaling receiver, and is configured to provide a display data in a binary form to the data input end during normally displaying.

According to an embodiment, the data input end may be a data input end of the source drive circuit, or also may be a data input end of another circuit unit which provides the display data to the display panel.

Figure 3:
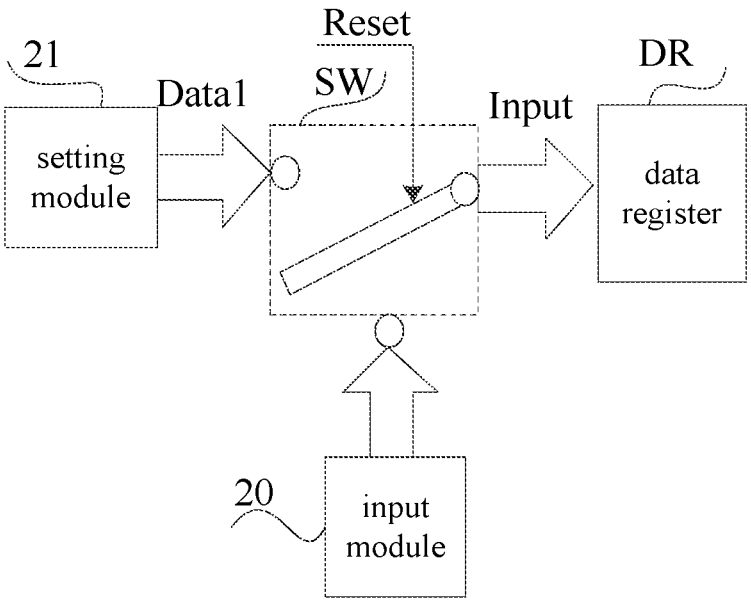
FIG. 3 is a structural view of a data input unit of an embodiment of the present disclosure.

According to an embodiment, as illustrated in FIG. 3, the external control signal may comprise a shutdown control signal Reset. The selection module may comprise a bidirectional switch SW. The setting module 21 is configured to preset a first display data Data1. The bidirectional switch SW may comprise a control end, a first input end, a second input end and an output end; the control end of the bidirectional switch SW receives the shutdown control signal Reset, the first input end of the bidirectional switch SW is connected with the setting module 21, the second input end of the bidirectional switch SW is connected with the input module 20, and the output end of the bidirectional switch SW is connected with the data input end Input. In the case that the shutdown control signal Reset is effective, the bidirectional switch SW is configured to control the setting module 21 to provide the first display data Data1 to the data input end Input, and in the case that the shutdown control signal Reset is ineffective, the bidirectional switch SW is configured to control the input module 20 to provide a normal display data to the data input end Input. Herein, a signal is effective means that the corresponding signal can control the first input end of the bidirectional switch SW to be connected to the output end of the bidirectional switch SW, and a signal is ineffective means that the corresponding signal can control the second input end of the bidirectional switch SW to be connected to the output end of the bidirectional switch SW.

As illustrated in FIG. 3, the data input end Input may be connected with a data register DR of the source drive circuit, so as to provide the display data to the data register DR through the data input end Input.

In the case that a display device is shut down, during the shutdown time period from detecting a shutdown signal to shutting down the power supply, the shutdown control signal Reset is effective. According to an embodiment, the electric potential of the Reset may be controlled to be a low level at this time. For a time period that is not in the above mentioned shutdown time period, the shutdown control signal Reset is ineffective. According to an embodiment, the electric potential of the shutdown control signal Reset may be controlled to be a high level at this time. However, it should be understood that the effective electric potential and ineffective electric potential of the Reset may be set as required, which is not limited to the above mentioned setting.

In the embodiment as illustrated in FIG. 3, the grayscale value of the first display data Data1 is 0. Thus, in the case that the shutdown control signal Reset is effective, a data signal of the black image is provided to a data line through the data input end Input, so that the black image is output to the display panel. Thus, the display panel displays the black image during shutting down, so as to avoid the user from seeing an image that is generated due to the shutdown timing and not necessary to be shown to the user.

Figure 4:
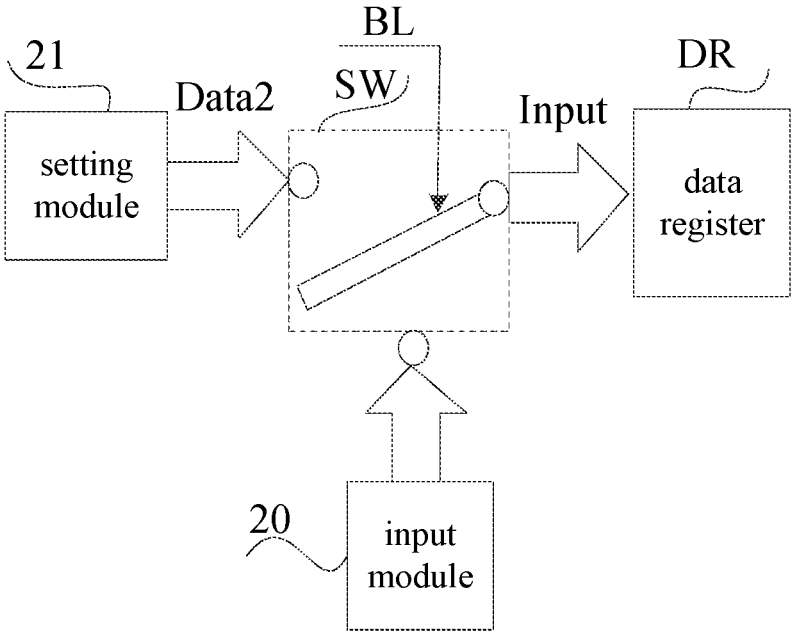
FIG. 4 is a structural view of a data input unit of other embodiment of the present disclosure.

According to another embodiment, as illustrated in FIG. 4, the external control signal may comprise a blank interval control signal BL. The selection module may comprise the bidirectional switch SW. The setting module 21 is configured to preset a second display data Data2, and the grayscale value of second display data Data2 is in a predetermined range. The bidirectional switch SW may comprise the control end, the first input end, the second input end and the output end, the control end of the bidirectional switch SW receives the blank interval control signal BL, the first input end of the bidirectional switch SW is connected with the setting module 21, the second input end of the bidirectional switch SW is connected with the input module 20, and the output end of the bidirectional switch SW is connected with the data input end Input. In the case that the blank interval control signal BL is effective, the bidirectional switch SW is configured to control the setting module 21 to provide the second display data Data2 to the data input end Input, so as to display a grayscale image on the display panel connected with the data input end Input, and in the case that the blank interval control signal BL is ineffective, the bidirectional switch SW is configured to control the input module 20 to provide a normal display data to the data input end Input.

As illustrated in FIG. 4, the data input end Input may be connected with the data register DR included in the source drive circuit, so as to provide the display data to the data register DR through the data input end Input.

In the embodiment illustrated in FIG. 4, in a blank interval between two frames of display data, the blank interval control signal BL is effective. According to an embodiment, the electric potential of the blank interval control signal BL may be controlled to be a high level at this time. And not in the blank interval, the electric potential of the blank interval control signal BL may be controlled to be a low level. In the case that the blank interval control signal BL is effective, the second display data Datat2 is input to the source drive circuit, so as to display a grayscale image on the display panel connected with the source drive circuit, namely, the grayscale image is inserted in the blank interval between two frames of display data to improve the display quality.

It should be understood that the effective electric potential and ineffective electric potential of the blank interval control signal BL may be set as required, which is not limited to the above mentioned setting.

Figure 5:
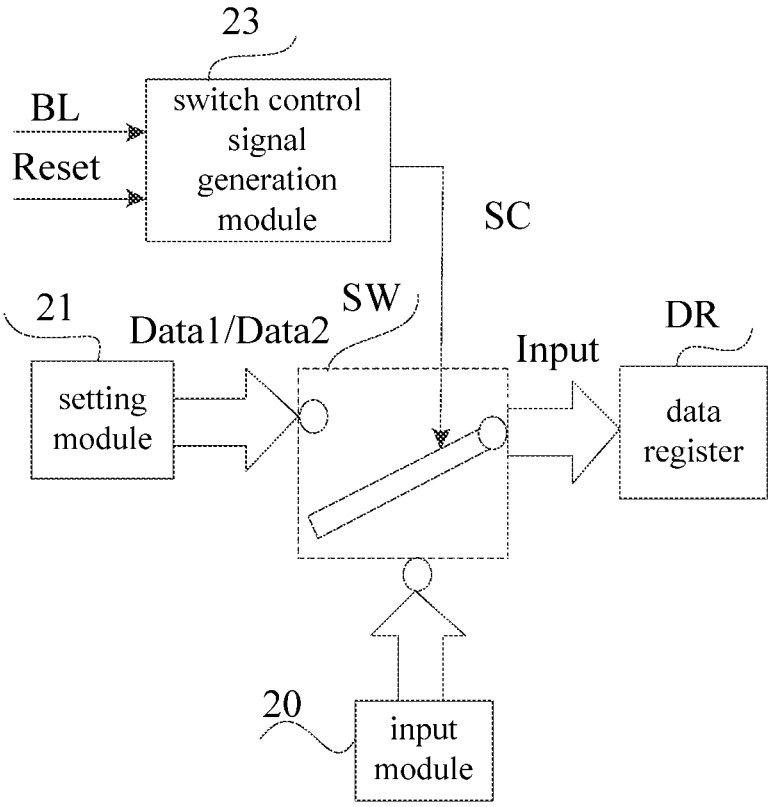
FIG. 5 is a structural view of a data input unit of another embodiment of the present disclosure.

According to another embodiment of the present disclosure, as illustrated in FIG. 5, the data input unit further comprises a switch control signal generation module 23. The external control signal comprises the shutdown control signal Reset and the blank interval control signal BL. The selection module comprises the bidirectional switch SW.

The switch control signal generation module 23 generates a switch control signal SC according to the shutdown control signal Reset and the blank interval control signal BL. In the case that the shutdown control signal Reset is effective or the blank interval control signal BL is effective, the switch control signal SC is controlled to be in a first state. In the case that the shutdown control signal Reset and the blank interval control signal BL both are ineffective, the switch control signal SC is controlled to be in a second state.

The setting module 21 presets the first display data Data1 and the second display data Datat2. A control end of the setting module 21 further receives an input control signal.

The bidirectional switch SW comprises a control end, a first input end, a second input end and an output end, the control end of the bidirectional switch SW receives the switch control signal SC, the first input end of the bidirectional switch SW is connected with the setting module 21, the second input end of the bidirectional switch SW is connected with the input module 20, and the output end of the bidirectional switch SW is connected with the data input end Input. In the case that the switch control signal SC is in the first state and the shutdown control signal Reset is effective, the bidirectional switch SW controls the setting module 21 to provide the first display data Data1 to the data input end Input. In the case that the switch control signal SC is in the first state and the blank interval control signal BL is effective, the bidirectional switch SW controls the setting module 21 to provide the second display data Data2 to the data input end Input. In the case that the switch control signal SC is in the second state, the bidirectional switch SW controls the input module 20 to provide a normal display data to the data input end Input.

The grayscale value of the first display data Data1 is 0. In the case that the data input end Input receives the second display data Data2, a grayscale image may be displayed on the display panel connected with the data input end Input.

As illustrated in FIG. 5, a data input unit according to an embodiment of the present disclosure uses the switch control signal generation module to generate the switch control signal according to the shutdown control signal and the blank interval control signal, and controls the bidirectional switch according to the switch control signal. Therefore, in the case that the shutdown control signal is effective, the setting module may be controlled to provide the first display data to the data input end so as to display the black image on the display panel, so that the display screen displays the black image during shutting down, so as to avoid the user from seeing an image that is generated due to the shutdown timing and not necessary to be shown to the user; in the case that the blank interval control signal is effective, the setting module is controlled to provide the second display data to the data input end to display the grayscale image on the display panel, namely the grayscale image is inserted in the blank interval between two frames of display data to improve the display quality, and in the case that the shutdown control signal and the blank interval control signal both are ineffective, the input module is controlled to provide the normal display signal.

According to an embodiment, the switch control signal generation module may comprise an OR gate. The OR gate may comprise a first OR gate input end, a second OR gate input end and an OR gate output end; the first OR gate input end receives the blank interval control signal, the second OR gate input end receives a reverse signal of the shutdown control signal, and the OR gate output end is connected with the control end of the bidirectional switch.

The data input unit of the present disclosure is further described in conjunction with FIG. 6 to FIG. 8 below. In the example illustrated in FIG. 6 to FIG. 8, the data input unit provides the following normal display data to the data input end of the source drive circuit. The display data comprises 6-bit red display data R0-R5, 6-bit green display data G0-G5 and 6-bit blue display data B0-B5. Namely, the format of the display data is a 6-bit 3-string differential input signal. However, it should be understood that the display data input into the data input unit of the present disclosure is not limited to the number of bits of the display data, data format of the signal, strings of the signal, and the driving channel number of the source drive circuit in the above mentioned.

Figure 6:
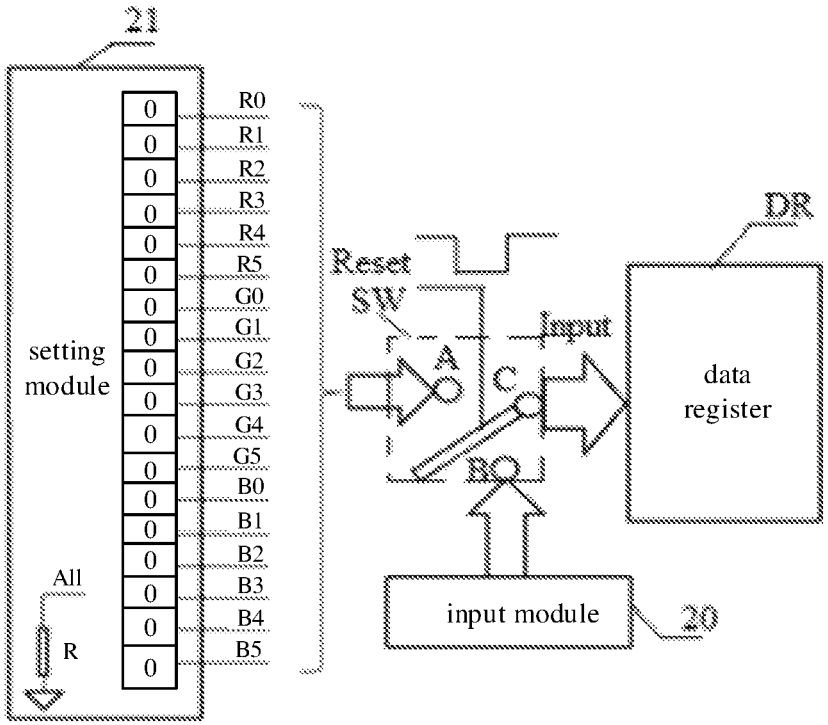
FIG. 6 is a structural view of a first embodiment of a data input unit of the present disclosure.

In the example illustrated in FIG. 6, the data input unit may comprise the input module 20, the setting module 21 and the selection module. The source drive circuit comprises the data register DR, so as to receive the normal display data from the data input unit through the data input end Input. The selection module receives the external control signal; the external control signal may comprise the shutdown control signal Reset, and the shutdown control signal Reset is effective at the low level and is ineffective at the high level. The selection module may comprise the bidirectional switch SW. The setting module 21 presets the first display data Data1. As illustrated in FIG. 6, for instance, the values of R0-R5, the values of G0-G5 and the values of B0-B5 may all be 0. The bidirectional switch SW may comprise a control end, a first input end A, a second input end B and an output end C; the control end of the bidirectional switch SW receives the shutdown control signal Reset, the first input end A of the bidirectional switch SW is connected with the setting module 21, the second input end B of the bidirectional switch SW is connected with the input module 20, and the output end C of the bidirectional switch SW is connected with the data input end Input of the source drive circuit.

In the case that the electrical potential of the shutdown control signal Reset is the low level, the first input end A of the bidirectional switch SW and the output end C of the bidirectional switch SW are turned on, so that the setting module 21 outputs the Data1 to the data input end Input so as to display the black image on the display panel. In this way, the display screen displays the black image during shutting down, so as to avoid the user from seeing an image that is generated due to the shutdown timing and not necessary to be shown to the user. In the case that the electrical potential of the shutdown control signal Reset is the high level, the second input end B of the bidirectional switch SW and the output end C of the bidirectional switch SW are turned on, so that the input module outputs the normal display data to the data input end Input.

In FIG. 6, the R indicates a resistor, All indicates all registers in FIG. 6. That is to say, in the example as illustrated in FIG. 6, all registers are set to connect with pull-down resistances, and values stored in all registers are set to be 0.

Figure 7:
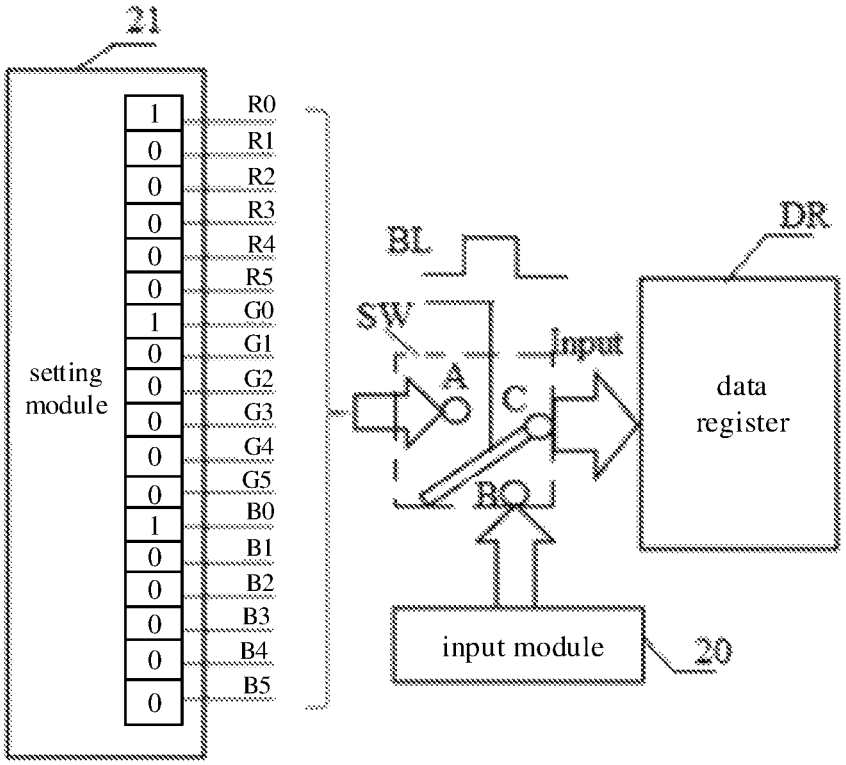
FIG. 7 is a structural view of a second embodiment of a data input unit of the present disclosure.

In the example as illustrated in FIG. 7, the data input unit comprises the input module 20, the setting module 21 and the selection module. The source drive circuit comprises the data register DR, so as to receive the normal display data from the data input unit through the data input end Input. The selection module receives the external control signal; the external control signal may comprise the blank interval control signal BL, the blank interval control signal BL is effective at the high level, and is ineffective at the low level. The selection module may comprise the bidirectional switch SW. The setting module 21 presets the second display data Data2. As illustrated in FIG. 7, for instance, the values of R1-R5, the values of G1-G5 and the values of B1-B5 may all be 0, and the value of R0, the value of G0 and the value of B0 may all be 1. The bidirectional switch SW may comprise a control end, a first input end A, a second input end B and an output end C; the control end of the bidirectional switch SW receives the blank interval control signal BL, the first input end A of the bidirectional switch SW is connected with the setting module 21, the second input end B of the bidirectional switch SW is connected with the input module 20, and the output end C of the bidirectional switch SW is connected with the data input end Input of the source drive circuit.

In the case that the electrical potential of the blank interval control signal BL is the high level, the first input end A of the bidirectional switch SW and the output end C of the bidirectional switch SW are turned on, so that the setting module 21 outputs the Data2 to the data input end Input so as to display the grayscale image on the display panel, namely the grayscale image is inserted in the blank interval between two frames of display data to improve the display quality. In the case that the electrical potential of the blank interval control signal BL is the low level, the second input end B of the bidirectional switch SW and the output end C of the bidirectional switch SW are turned on, so that the input module outputs the normal display data to the data input end Input.

In the example of the data input unit illustrated in FIG. 7, an R/L signal (namely a shift direction control signal) which the source drive circuit receives is 0. Therefore, in the Data2, the red display data R is 100000, the green display data G is 100000, and the blue display data B is 100000, namely the grayscale value of the Data2 is 127 which is the middle grayscale. Inserting of a grayscale image in the blank interval is favorable to the grayscale transition between two frames, and is also favorable to balance the interactive influence of the data lines located in the blank interval of all the display periods on the peripheral pixel capacitance.

In the example of the data input unit illustrated in FIG. 6 and FIG. 7, the predetermined display data stored in the setting module is fixed. The predetermined display data may be set up by hardware as required during manufacturing integrated circuit. However, it should be understood that the predetermined display data stored in the setting module may also be set to a certain value as required, for instance, a 6-bit data L0 (000000), a 6-bit data L255 (111111) or other values.

Figure 8:
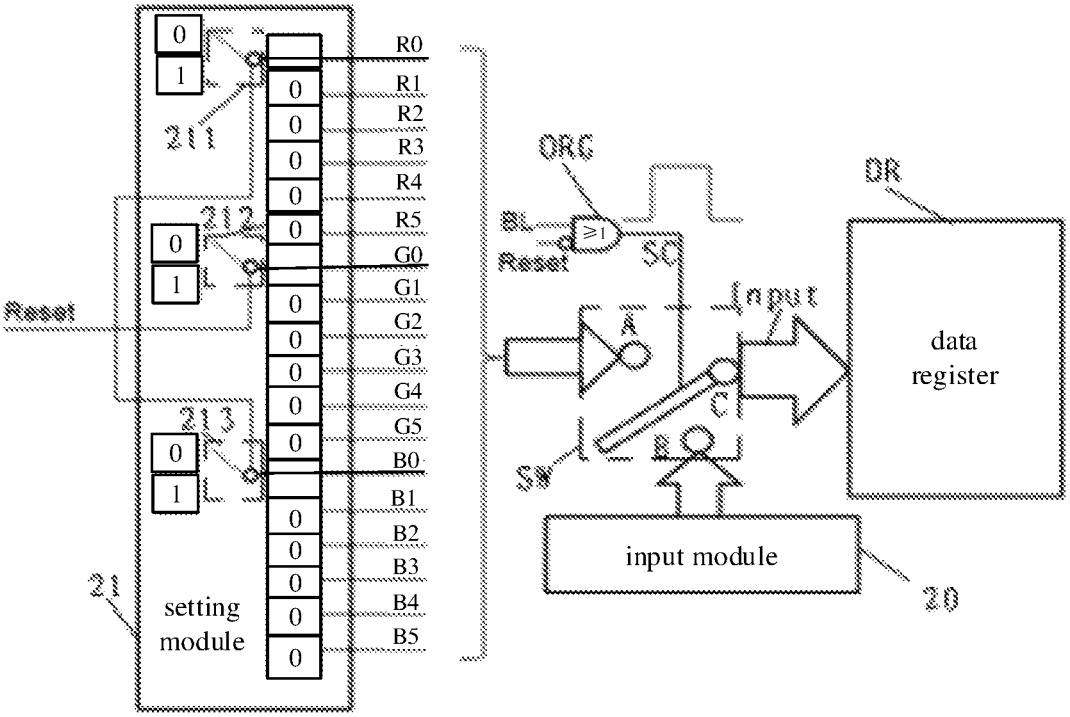
FIG. 8 is a structural view of a third embodiment of a data input unit of the present disclosure.

In the example as illustrated in FIG. 8, the data input unit comprises the input module 20, the setting module 21 and the selection module. The source drive circuit comprises the data register DR, so as to receive the normal display data from the data input unit through the data input end Input. The selection module receives the external control signal. The external control signal may comprise the shutdown control signal Reset and the blank interval control signal BL. The selection module comprises the bidirectional switch SW.

The data input unit may further comprise the switch control signal generation module. The switch control signal generation module comprises an OR gate ORG. The OR gate ORG comprises a first OR gate input end, a second OR gate input end, and an OR gate output end; the first OR gate input end of the ORG receives the blank interval control signal BL, the second OR gate input end of the ORG receives a reverse signal of the shutdown control signal Reset, and the OR gate output end of the ORG is connected with the control end of the SW. The OR gate output end of the ORG outputs the switch control signal SC; in the case that the electrical potential of the shutdown control signal Reset is the low level or the electrical potential of the BL is the high level, the switch control signal SC output by the OR gate output end of the ORG is the high level, and in the case that the shutdown control signal Reset is the high level and/or the electrical potential of the BL is the low level, the switch control signal SC output by the OR gate output end of the ORG is the low level.

The setting module 21 presets the first display data Data1 and the second display data Data2, and comprises a first switch 211, a second switch 212 and a third switch 213; a control end of the first switch 211, a control end of the second switch 212 and a control end of the third switch 213 all are configured to receive the shutdown control signal Reset. In the case that the electrical potential of the Reset is the low level, the first switch 211 controls the value of R0 to be 0, the first switch 211 controls the value of G0 to be 0 and the first switch 211 controls the value of B0 to be 0. In the case that the electrical potential of the Reset is the high level, the first switch 211 controls the value of R0 to be 1, the first switch 211 controls the value of G0 to be 1 and the first switch 211 controls the value of B0 to be 1. The values of R1-R5, the values of G1-G5 and the values of B1-B5 all are fixed at 0.

The bidirectional switch SW comprises a control end, a first input end A, a second input end B and an output end C; the control end of the bidirectional switch SW receives the switch control signal SC, the first input end A of the bidirectional switch SW is connected with the setting module 21, the second input end B of the bidirectional switch SW is connected with the input module 20, and the output end C of the bidirectional switch SW is connected with the data input end Input of the source drive circuit.

In the case that the electrical potential of the switch control signal SC output by the OR gate ORG is the high level, the first input end A of the bidirectional switch SW is connected with the data input end Input. At this time, if the electrical potential of the shutdown control signal Reset is the low level, the setting module 21 provides the first display data to the data register DR through the data input end Input, and in the first display data, the values of R0-R5 are 0, the values of G0-G5 are 0 and the values of B0-B5 are 0. In the case that the switch control signal SC and the shutdown control signal Reset both are the high level, the setting module 21 provides the second display data to the data register DR through the data input end Input, and in the second display data, the value of R0, the value of G0 and the value of B0 all are 1, the values of R1-R5 are 0, the values of G1-G5 are 0 and the values of B1-B5 are 0. In the case that the switch control signal SC output by the OR gate ORG is the low level, the second input end B of the bidirectional switch SW is connected with the Input, so that the input module 20 provides the normal display data to the data register DR through the data input end Input.

In the example of the data input unit as illustrated in FIG. 8, the switch control signal SC is generated by the OR gate ORG according to the shutdown control signal Reset and the blank interval control signal BL, and the bidirectional switch is controlled according to the switch control signal SC. Therefore, in the case that the shutdown control signal is effective, the setting module provides the First display data to the data input end to display the black image on the display panel, thus the display panel displays the black image during shutting down, so as to avoid the user from seeing an image that is generated due to the shutdown timing and not necessary to be shown to the user; in the case that the blank interval control signal is effective, the setting module provides the second display data to the data input end, so as to display the grayscale image on the display panel, namely the grayscale image is inserted in the blank interval between two frames of display data to improve the display quality; and in the case that the shutdown control signal and the blank interval control signal both are ineffective, the input module provides the normal display data to the data input end.

In the example of the data input unit of the present disclosure as illustrated in FIG. 6, FIG. 7 and FIG. 8, the input module 20 may comprise an input signal receiver. For instance, the input module 20 may be the Mini low-voltage differential signaling receiver.

Figure 9:
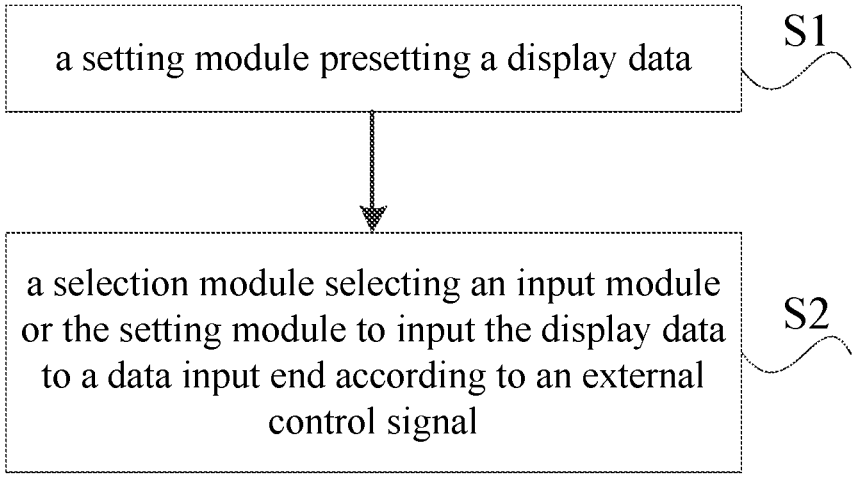
FIG. 9 is a flow chart of a data input method of an embodiment of the present disclosure.

FIG. 9 shows a data input method according to embodiments of the present disclosure, the method comprises the following operations:

Step S1: presetting one or more predetermined display data by a setting module; and Step S2: according to an external control signal, selecting an input module or the setting module to provide a display data to a data input end by a selection module.

In the data input method according to the embodiment of the present disclosure, one or more predetermined display data corresponding to a special display demand is preset by the setting module, then according to the external control signal, the selection module selects whether the setting module needs to provide the display data to the data input end, which can satisfy the special display demand, for instance, the black image may be displayed on the display panel during the display device being shut down, or the grayscale image is inserted in the blank interval between two frames of display data to improve display quality.

According to an embodiment, the data input end may be a data input end of the source drive circuit, and also may be a data input end of another circuit unit which provides the display data to the display panel.

According to an embodiment, the external control signal may comprise a shutdown control signal, and the selection module may comprise a bidirectional switch. The step S1 may comprise: presetting a first display data by the setting module. The grayscale value of the first display data may be 0. The step S2 may comprise: in the case that the shutdown control signal is effective, controlling the setting module to provide the first display data to the data input end by the bidirectional switch of the selection module, and in the case that the shutdown control signal is ineffective, controlling an input module to provide a normal display data to the data input end by the bidirectional switch of the selection module.

According to an embodiment, the external control signal may comprise a blank interval control signal. The step S1 may comprise: presetting a second display data by the setting module. The grayscale value of the second display data is in a predetermined range. The step S2 may comprise: in the case that the blank interval control signal is effective, controlling the setting module to provide the second display data to the data input end through the bidirectional switch of the selection module, and in the case that the blank interval control signal is ineffective, controlling the input module to provide the normal display data to the data input end through the bidirectional switch of the selection module. In the case that the data input end receives the second display data, a grayscale image may be displayed on the display panel connected with the data input end.

According to other embodiments, the data input unit may further comprise a switch control signal generation module, the external control signal may comprise the shutdown control signal and the blank interval control signal, and the selection module may comprise the bidirectional switch. The switch control signal generation module generates a switch control signal according to the shutdown control signal; in the case that the shutdown control signal is effective or the blank interval control signal is effective, the switch control signal is controlled to be in a first state, and in the case that the shutdown control signal and the blank interval control signal both are ineffective, the switch control signal is controlled to be in a second state. The setting module presets the first display data and the second display data. A control end of the setting module may also receive an input control signal. The bidirectional switch comprises a control end, a first input end, a second input end and an output end; the control end of the bidirectional switch receives the switch control signal, the first input end of the bidirectional switch is connected with the setting module, the second input end of the bidirectional switch is connected with the input module, and the output end of the bidirectional switch is connected with the data input end. In the case that the switch control signal is in the first state and the shutdown control signal is effective, the bidirectional switch controls the setting module to provide the first display data to the data input end. In the case that the switch control signal is in the first state and the blank interval control signal is effective, the bidirectional switch controls the setting module to provide the second display data to the data input end. In the case that the switch control signal is in the second state, the bidirectional switch controls the input module to provide the normal display data to the data input end. The grayscale value of the first display data may be 0. In the case that the data input end receives the second display data, the grayscale image may be displayed on the display panel connected with the data input end.

According to embodiments of the present disclosure, the source drive circuit may comprise the data input end and the above mentioned data input unit, and the data input unit controls the input module or the setting module to provide the display data to the data input end.

According to embodiments of the present disclosure, a display device may comprise the above mentioned source drive circuit.

On the basis of a common source driving integrated circuit, a new structural unit is integrated and is controlled by an external control signal of the integrated circuit. Therefore, besides a normal driving function, other special driving functions can be realized, so as to improve the performance and display quality of a display apparatus.

It should be understood that some improvements and modification can be made without departing from the spirit of the disclosure, and these improvements and modification fall into the scopes of the disclosure.

The application claims priority to the Chinese patent application No. 201610055243.4, filed on Jan. 27, 2016, the entire disclosure of which is incorporated herein by reference as part of the present application.

What is claimed is:

1. A data input unit, comprising:

an input circuit, configured to provide a normal display data;

a setting circuit, configured to preset one or more predetermined display data; and a selection circuit, configured to select the input circuit to provide the normal display data to a data input end or select the setting circuit to provide a special predetermined display data to the data input end, according to one or more external control signals;

wherein, the external control signal comprises a shutdown control signal and a blank interval control signal, and the setting circuit is configured to preset a first predetermined display data, the grayscale value of which is 0, and a second predetermined display data, the grayscale value of which is in a predetermined range;

in a case that the shutdown control signal is effective, the selection circuit controls the setting circuit to provide the first predetermined display data to the data input end;

in a case that the blank interval control signal is effective, the selection circuit controls the setting circuit to provide the second predetermined display data to the data input end, so as to display a grayscale image on a display panel connected with the data input end; and in a case that the shutdown control signal and the blank interval control signal both are ineffective, the selection module circuit controls the input module circuit to provide the normal display data to the data input end.

2. The data input unit according to claim 1, wherein, in a case that an effective external control signal is in the one or more external control signals, the selection circuit controls the setting circuit to provide a predetermined display data corresponding to the effective external control signal to the data input end; and in a case that the one or more external control signals are ineffective, the selection circuit controls the input circuit to provide the normal display data to the data input end.

3. The data input unit according to claim 1, further comprising:

a switch control signal generation circuit, configured to generate a switch control signal according to the shutdown control signal and the blank interval control signal, wherein, in the case that the shutdown control signal is effective or the blank interval control signal is effective, the switch control signal is controlled to be in a first state, in the case that the shutdown control signal and the blank interval control signal both are ineffective, the switch control signal is controlled to be in a second state;

wherein, in a case that the switch control signal is in the first state and the shutdown control signal is effective, the setting circuit is controlled to provide the first predetermined display data to the data input end, in a case that the switch control signal is in the first state and the blank interval control signal is effective, the setting circuit is controlled to provide the second predetermined display data to the data input end, so as to display the grayscale image on the display panel connected with the data input end, and in a case that the switch control signal is in the second state, the input circuit is controlled to provide the normal display data to the data input end.

4. The data input unit according to claim 3, wherein the switch control signal generation circuit comprises:

an OR gate, a first OR gate input end of which receives the blank interval control signal, a second OR gate input end of which receives a reverse signal of the shutdown control signal, and an OR gate output end of which is connected with the selection circuit.

5. The data input unit according to claim 1, wherein the selection circuit comprises:

a bidirectional switch, a control end of which receives the one or more external control signals or a control signal obtained according to the one or more external control signals, a first input end of which is connected with the setting circuit, a second input end of which is connected with the input circuit, and an output end of which is connected with the data input end.

6. A source drive circuit, comprising a data input end and the data input unit according to claim 1.

7. A display device, comprising the source drive circuit according to claim 6.

8. A data input method, comprising:

presetting one or more predetermined display data by a setting circuit; and according to one or more external control signals, selecting an input circuit to provide a normal display data to a data input end or selecting the setting circuit to provide a special predetermined display data to the data input end;

wherein, the external control signal comprises a shutdown control signal and a blank interval control signal, and the setting circuit is configured to preset a first predetermined display data, the grayscale value of which is 0, and a second predetermined display data, the grayscale value of which is within a predetermined range;

in a case that the shutdown control signal is effective, the selection circuit controls the setting circuit to provide the first predetermined display data to the data input end;

in a case that the blank interval control signal is effective, the selection circuit controls the setting circuit to provide the second predetermined display data to the data input end, so as to display a grayscale image on a display panel connected with the data input end; and in a case that the shutdown control signal and the blank interval control signal both are ineffective, the selection module circuit controls the input circuit to provide the normal display data to the data input end.

9. The data input method according to claim 8, wherein, in a case that an effective external control signal is in the one or more external control signals, the selection module circuit controls the setting circuit to provide a predetermined display data corresponding to the effective external control signal to the data input end; and in a case that the one or more external control signals are ineffective, the selection circuit controls the input circuit to provide the normal display data to the data input end.

* * * * *